US009596907B2

(12) United States Patent
Yang et al.

(10) Patent No.: US 9,596,907 B2
(45) Date of Patent: Mar. 21, 2017

(54) STRAP ASSEMBLY AND FASTENING UNIT THEREOF

(71) Applicant: Wistron NeWeb Corp., Hsinchu (TW)

(72) Inventors: Chung-Yuan Yang, Hsinchu (TW); Jen-Yung Chang, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 0 days.

(21) Appl. No.: 14/833,967

(22) Filed: Aug. 24, 2015

(65) Prior Publication Data

US 2016/0157562 A1 Jun. 9, 2016

(30) Foreign Application Priority Data

Dec. 8, 2014 (TW) ..... 103142542 A

(51) Int. Cl.
*A44B 11/12* (2006.01)
*A44B 11/16* (2006.01)

(52) U.S. Cl.
CPC ..... *A44B 11/12* (2013.01); *A44B 11/16* (2013.01)

(58) Field of Classification Search
CPC ..... A44B 11/12; A44B 11/16; Y10T 24/4084; Y10T 24/4077; Y10T 24/4016; Y10T 24/4072; Y10T 24/4086
See application file for complete search history.

(56) References Cited

U.S. PATENT DOCUMENTS 2,836,868 A * 6/1958 Carter ..... A44B 11/2526 24/171
3,004,316 A * 10/1961 Schuhmann ..... A44B 11/2588 24/197
3,365,756 A * 1/1968 Bayon ..... A44B 11/25 24/196
3,805,334 A * 4/1974 Graup ..... A43C 11/1413 24/173
4,685,315 A * 8/1987 Comolli ..... A44B 11/005 190/120
4,726,625 A * 2/1988 Bougher ..... A44B 11/12 24/170
4,942,647 A * 7/1990 Wallner ..... A44B 11/125 24/170

(Continued)

FOREIGN PATENT DOCUMENTS

TW M453393 5/2013
TW I457087 10/2014

*Primary Examiner* — Robert J Sandy
*Assistant Examiner* — David Upchurch
(74) *Attorney, Agent, or Firm* — Muncy, Geissler, Olds & Lowe, P.C.

(57) ABSTRACT

A fastening unit includes a base, a fixing seat, two shaft seats, a main body, an engaging member, and an abutting member. The fixing seat and the two shaft seats are disposed on the base. The main body is detachably disposed on the two shaft seats. The engaging member is connected to the side of the main body that is away from the two shaft seats. The abutting member protrudes from the bottom surface of the main body. When the fastening unit is in a closed state, the engaging member engages with the fixing seat. As a result, the bottom surface faces the base, and the abutting member is adjacent to the base. When the fastening unit is transferred from the closed state to an opened state, the engaging member disengages from the fixing seat, and the main body pivots relative to the two shaft seats.

8 Claims, 5 Drawing Sheets

(56) References Cited

U.S. PATENT DOCUMENTS

| | | | | |
|---|---|---|---|---|
| 5,669,253 | A * | 9/1997 | Higgins | E05B 37/14 70/14 |
| 6,665,913 | B2 * | 12/2003 | Kosh | A44B 11/12 24/170 |
| 7,004,547 | B1 * | 2/2006 | Cheng | B60R 22/19 24/170 |
| 7,808,386 | B1 * | 10/2010 | Sayegh | E05B 73/0017 235/385 |
| 8,746,742 | B2 * | 6/2014 | Heath | B60R 22/19 24/170 |
| 8,898,865 | B2 * | 12/2014 | Campbell | B60R 22/024 24/169 |
| 8,935,833 | B2 * | 1/2015 | Kaneko | A44B 11/12 24/170 |
| 2003/0140461 | A1 * | 7/2003 | Wilcock | A44B 11/2569 24/191 |
| 2006/0289575 | A1 * | 12/2006 | Chou | A45F 5/00 224/264 |
| 2007/0193004 | A1 * | 8/2007 | Chou | A44B 11/006 24/170 |
| 2009/0172923 | A1 * | 7/2009 | Miotto | A44B 11/28 24/193 |
| 2010/0000056 | A1 * | 1/2010 | Hsieh | A44B 11/16 24/163 R |
| 2013/0286797 | A1 * | 10/2013 | Leger | A44C 5/246 368/282 |

* cited by examiner

STRAP ASSEMBLY AND FASTENING UNIT THEREOF

CROSS REFERENCE TO RELATED APPLICATIONS

This Application claims priority of Taiwan Patent Application No. 103142542, filed on Dec. 8, 2014, the entirety of which is incorporated by reference herein.

BACKGROUND

Field of the Invention

The present invention relates to a strap assembly and an element thereof, and more particularly to a strap assembly with an adjustable length, and the fastening unit thereof.

Description of the Related Art

Many strap assembles are available on the market for hanging objects such as a badge, an electric device, etc. For example, Taiwan Utility Patent No. M225899 discloses a strap assembly for gripping a badge. The length of the strap assembly is adjusted via an adjusting ring, and the strap assembly includes two separable fasteners to improve safety in the use of the strap assembly.

However, the adjusting ring and the fasteners are two different structures, which cause an increase in the weight of the strap assembly and makes the assembly process of the strap assembly very complicated. In addition, while the strap assembly is being used, the neck of the user may be constricted by the adjusting ring and the user may feel uncomfortable. Moreover, while the adjusting ring of the strap assembly can be used to adjust the length of the strap, the surplus portion of the strap is exposed by the adjusting ring. If the surplus portion of the strap is dragged by other elements in the environment, an accident may occur to the user.

SUMMARY

Due to the drawbacks in the prior art, the aspect of the disclosure is to provide a fastening unit connected to a strap. The fastening unit is used to adjust the length of the strap. Besides, by using two separable elements to fix the strap, the safety of the user is also guaranteed.

According to one embodiment of the disclosure, the strap assembly includes a base, a fixing seat, two shaft seats, a main body, an engaging member, and an abutting member. The fixing seat is positioned on the base. The two shaft seats are arranged side by side and disposed on the base in such a way that the two shaft seats are spaced apart from each other in a second direction. Each of the two shaft seats is spaced from the fixing seat along a first direction by a distance, and the first direction is perpendicular to the second direction. The main body is detachably positioned on the two shaft seats. The engaging member is connected to the side of the main body that is away from the two shaft seats. The abutting member is projected from a bottom surface of the main body. When the fastening unit is in a closed state, the engaging member engages with the fixing seat, and the bottom surface faces the base such that the abutting member is positioned adjacent to the base. When the fastening unit is transferred from the closed state to an opened state, the engaging member disengages from the fixing seat, and the main body pivots relative to the two shaft seats In the embodiment, the engaging member includes an elastic compression portion and an engaging portion. The elastic compression portion is connected to the main body. The engaging portion is connected to the main body via the elastic compression portion and is configured to engage with the fixing seat. When the fastening unit is transferred from the closed state to an opened state, the elastic compression portion is deformed so as to facilitate the disengagement of the elastic compression portion from the fixing seat.

In the embodiment, the elastic compression portion includes an extending segment enabling the engaging portion to have a degree of freedom in the first direction and/or a degree of freedom in a third direction perpendicular to the first and second directions.

In the embodiment, the elastic compression portion further includes a flexible segment. The flexible segment connects the extending segment to the engaging portion and is configured to provide flexibility to the engaging portion in the first direction.

In the embodiment, each of the two shaft seats comprises a shaft hole and a guiding groove connecting the shaft hole. Each of the guiding grooves is formed at the side of the corresponding shaft seat that is away from the fixing seat. In addition, the fastening unit includes two shafts. The two shafts are respectively formed at two sides of the main body and pivotably disposed on the two shaft holes of the two shaft seats. When the main body is pulled by an external force along a direction away from the fixing seat, the two shafts leave the shaft holes via the guiding grooves.

In the embodiment, a channel penetrates the fixing seat along the first direction, and the channel enables a strap to pass through. In the embodiment, a through hole is formed on the fixing seat at the side of the channel that is away from the base. When the fastening unit is in the closed state, the engaging member is connected to the fixing seat via the through hole.

In the embodiment, a through passage is formed at the side of the main body that is opposite to the side of the main body at which the engaging member is connected, and the through passage enables a strap to pass through.

Another aspect of the disclosure is to provide a strap assembly which includes a fastening assembly of any above-mentioned embodiment. A through passage is formed at the side of the main body that is opposite to the side where the engaging member is connected. A channel penetrates the fixing seat along the first direction. The first end of the strap is fixed on the through passage, and the second end of the strap passes through the channel and the interspace between the two shaft seats in order. When the fastening unit is in the closed state, the second end of the strap is abutted by the abutting member so as to position the strap on the base.

BRIEF DESCRIPTION OF THE DRAWINGS

For a more complete understanding of the embodiments, and the advantages thereof, reference is now made to the following descriptions taken in conjunction with the accompanying drawings.

DESCRIPTION OF THE ILLUSTRATIVE EMBODIMENTS

In the following description, a multi-view auto-stereoscopic display of the present invention will be explained with reference to embodiments thereof. It should be appreciated that these embodiments are not intended to limit the present invention to any specific environment, application or particular implementation described in these embodiments. Therefore, the description of these embodiments is only for the purpose of illustration rather than to limit the present invention. Furthermore, the attached drawings may be drawn in a slightly simplified or exaggerated way for ease of understanding; the numbers, shapes and dimensional scales of elements depicted may not be exactly the same as those in practical implementation and are not intended to limit the present invention.

Figure 1:
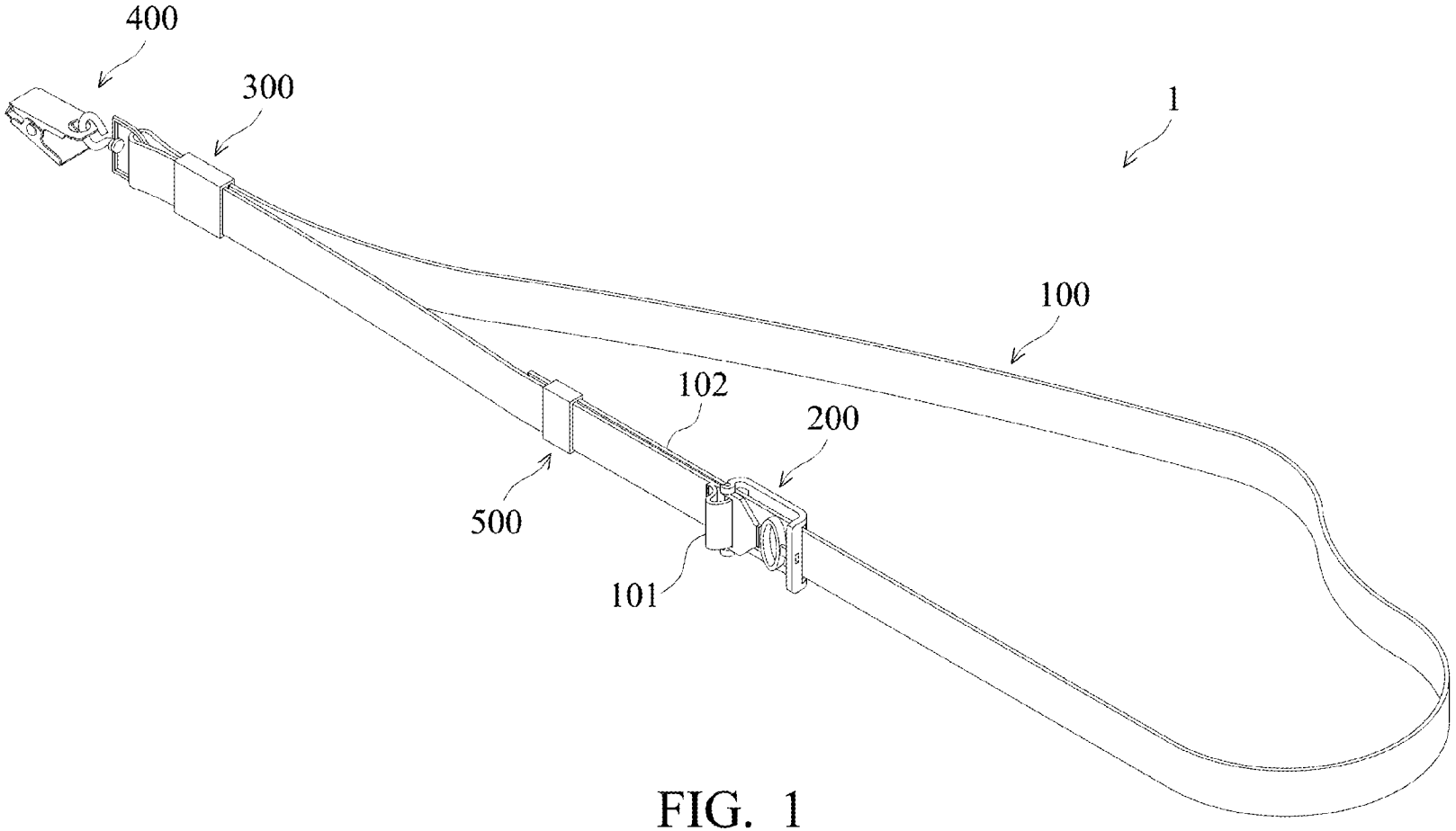
FIG. 1 shows a schematic view of a strap assembly, in accordance with a first embodiment of the disclosure.

Referring to FIG. 1, a strap assembly 1 is provided and includes a strap 100, a fastening unit 200, a positioning member 300, a gripping member 400, and an adjusting ring 500 in accordance with some embodiments. A first end 101 of the strap 100 is fixed on the fastening unit 200, and a second end 102 of the strap 100 is passed through the fastening unit 200. The strap 100 is also passed through the positioning member 300 and the gripping member 400. The gripping member 400 is configured to grasp an object, such as an electronic device or a badge. The positioning member 300 is configured to limit movements of the gripping member 400.

Figure 2:
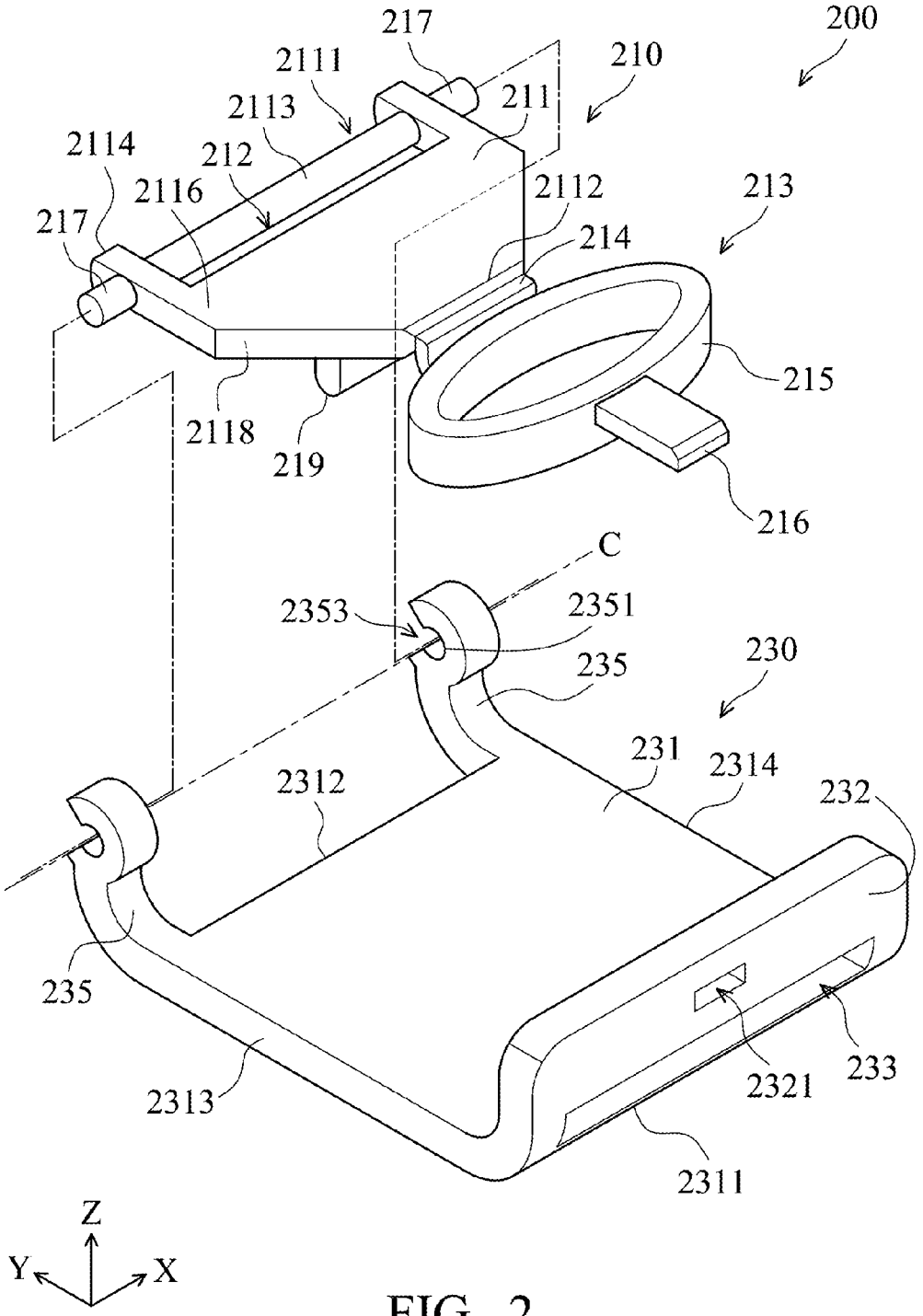
FIG. 2 shows an exploded view of a strap assembly, in accordance with the first embodiment of the disclosure.

Referring to FIG. 2, the structural features of the fastening unit 200 is described below. The fastening unit 200 includes a second structure 230 and a first structure 210 which is pivotably connected to the second structure 230 in a detachable manner.

In a first embodiment, the second structure 230 includes a base 231, a fixing seat 232, and two shaft seats 235. The base 231 has a number of sides, such as first side 2311, second side 2312, third side 2313, and fourth side 2314. The first side 2311 is opposite the second side 2312, and the third and fourth sides 2313 and 2314 are connected between the first and second sides 2311 and 2312.

In the first embodiment, the fixing seat 232 extends from the first side 2311 of the base 231 upwardly (Z axis direction), in which a channel 233 is arranged adjacent to the first side 2311 and penetrates the fixing seat 232 along a first direction (Y axis direction). Additionally, a through hole 2321 is formed on the fixing seat 232 at the side of the channel 233 that is away from the base 231. The through hole 2321 penetrates the fixing seat 232 along the first direction (Y axis).

In the first embodiment, two shaft seats 235 are arranged respectively adjacent to the third and fourth sides 2313/2314 and is extended from the base 231 upwardly (Z axis direction). Along the first direction (Y axis direction), the two shaft seats 235 are spaced apart from the fixing seat 232. Additionally, along a second direction (X axis direction), which is perpendicular to the first direction (Y axis direction), the two shaft seats 235 are arranged spaced apart from each other. Each of the shaft seats 235 includes a shaft hole 2351 and a guiding groove 2353. The shaft hole 2351 is formed at a distal end of the shaft seat 235. The guiding groove 2353 communicates the shaft hole 2351 and is formed at the side of the corresponding shaft seat 235 that is away from the fixing seat 232. In addition, as shown in FIG. 2, the shaft holes 2351 of the two shaft seats 235 align with a rotating axis C, where the rotating axis C is perpendicular to the first direction (Y axis direction).

In the first embodiment, the first structure 210 includes a main body 211, an engaging member 213, two shafts 217, and an abutting member 219. The main body 211 has a front lateral edge 2112 and a rear lateral edge 2114. As shown in FIG. 2, the width of a portion of the main body 211 that is near to the front lateral edge 2112 gradually decreases. As a result, the width of the front lateral edge 2112 of the main body 211 is smaller than the width of the rear lateral edge 2114 of the main body 211. Moreover, in the vicinity of the rear lateral edge 2114 of the main body 211, the two shafts 217 are respectively formed at two sides of the main body 211 relative to the shaft holes 2351 of the two shaft seats 235. While assembling the first structure 210 and the second structure 230, each of the two shafts 217 of the first structure 210 passes through the guiding grooves 2353 of the two shaft seats 235 and sits in the shaft holes 2351, so that the first structure 217 is able to pivot about the rotating axis C relative to the second structure 230.

In the first embodiment, in the vicinity of the rear lateral edge 2114 of the main body 211, a through passage 212 penetrates a top surface 2116 and a bottom surface 2118 of the main body 211. The through passage 212 allows a strap to pass (FIG. 1) through and letting the strap to be fixed on the first structure 210. Specifically, the main body 211 has a recessed portion 2111 and a cylindrical structure 2113. The recessed portion 211 is formed at the rear lateral edge 2114 of the main body 211, and the cylindrical structure 2113 is disposed in the recessed portion 2111. The through passage 212 is located between the cylindrical structure 2113 and the inner wall of the recessed portion 2111 that is away from the rear lateral edge 2114. The first end 101 (FIG. 1) of the strap 100 passes through the through passage 212 and is fixed on the cylindrical structure 2113.

In the first embodiment, the engaging member 213 includes an extending segment 214, a flexible segment 215, and an abutting portion 216. The extending segment 214 is connected to the front lateral edge 2112 of the main body 211. The extending segment 214 extends away from the main body 211 and connects to a side of the flexible segment 215. The flexible segment 215 has an elliptical shape, and the other side of the flexible segment 215 is connected to the engaging portion 216. Furthermore, the extending segment 214 and the flexible segment 215 together form an elastic compression portion which enables the engaging portion 216 to have a degree of freedom to displace. In addition, the abutting member 219 is formed on the bottom surface 2118 of the main body 211, and has a width in a direction parallel to the front lateral edge 2112 or the rear lateral edge 2114. The flexible segment 215 may have an X-shape, a funnel-shape, or any other shape which is capable of deforming. It should not be limited to the ring-shaped structure exemplified in the aforementioned embodiments.

Figure 3A:
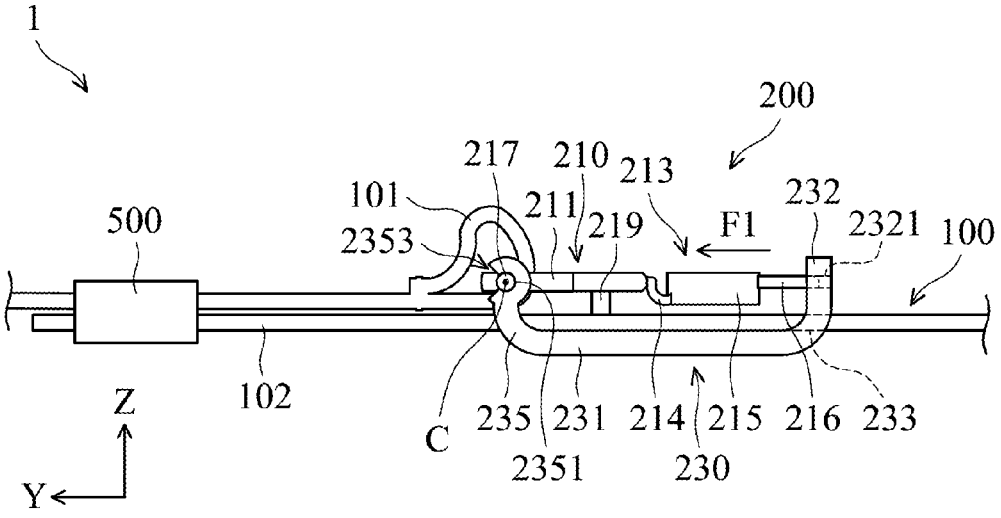
FIG. 3A shows a schematic view of the strap assembly in a closed state, in accordance with the first embodiment of the disclosure.
Figure 3B:
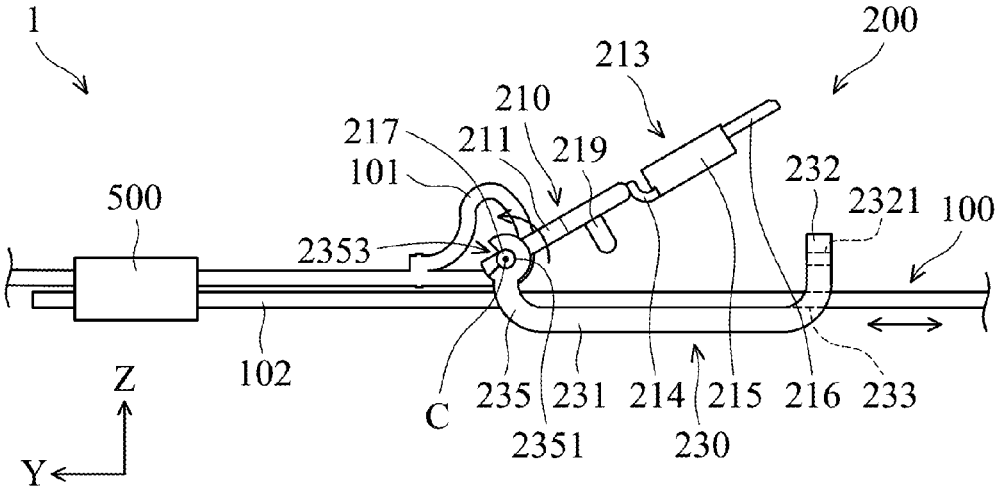
FIG. 3B shows a schematic view of the strap assembly in an opened state, in accordance with the first embodiment of the disclosure.

Referring to FIGS. 3A and 3B, a method for adjusting the length of the strap 100 of the strap assembly 1 is described below.

As shown in FIG. 3A, before the length of the strap 100 is adjusted, the fastening unit 200 is in a closed state, in which the first end 101 of the strap 100 is fixed on the first structure 210. The second end 102 of the strap 100 passes through an interspace between the two shaft seats 235 via the channel 233. The second end 102 of the strap 100 is fixed by the abutting member 219 of the first structure 210. Specifically, as the fastening unit 200 is in the closed state, the engaging portion 216 of the first structure 210 is limited by the through hole 2321 of the second structure 230. The shafts 217 of the first structure 210 are not allowed to pivot about the rotating axis C relative to the two shaft seats 235 of the second structure 230. Meanwhile, the strap 100 is abutted by the abutting member 219 and is not allowed to slide relative to the second structure 230.

To adjust the length of the strap 100, as shown in FIG. 3A, a force F1 is applied to the engaging member 213 of the first structure 210 along the first direction (Y axis direction) to allow the engaging portion 216 to be released from the through hole 2321. It should be noted that, while the engaging portion 216 is being released from the through hole 2321, the extending segment 214 and the flexible segment 215 are compressed and deformed by the force F1. At the same time, the extending segment 214 enables the engaging portion 216 to have a degree of freedom of along the first direction (Y axis direction) and/or a degree of freedom along the third direction (Z axis direction). In addition, the flexible segment 215 enables the engaging portion 216 to have a degree of freedom along the first direction (Y axis direction). As a result, the engaging portion 216 is movable along the first direction (Y axis direction) and/or the third direction (Z axis direction).

The movement of the engaging portion 216 is facilitated by the deformation of the extending segment 214 and the flexible segment 215 in the embodiments, nonetheless, the disclosure should not be limited those depicted above. In some other non-illustrated embodiments, the extending segment and the flexible segment of the engaging member are omitted. The main body is compressed therefore deformed, as a result, the engaging portion moves along the first direction (Y axis direction) and/or the third direction (Z axis direction).

After the engaging portion 216 is released from the through hole 2321 (see FIG. 3B), the first structure 210 is rotated about the rotating axis C, so that the abutting member 219 is moved away from the base 231. At the same time, since the second end 102 of the strap 100 is not abutted by the abutting member 219, the second end 102 of the strap 100 is allowed to be freely displacing relative to the second structure 230, so that the length of the strap 100 can be adjusted to have a wanted length. Additionally, the surplus portion of the second end 102 of the strap 100 may be received in the adjusting ring 500. After the length of the strap 100 is adjusted, the first structure 210 can be rotated about the rotating axis C, the abutting member 219 will then be approaching the base 231 Finally, the engaging portion 216 is engaged within the through hole 2321, as shown in FIG. 3A, thereby limiting the slidable displacement of the second end 102 of the strap 100.

Figure 4:
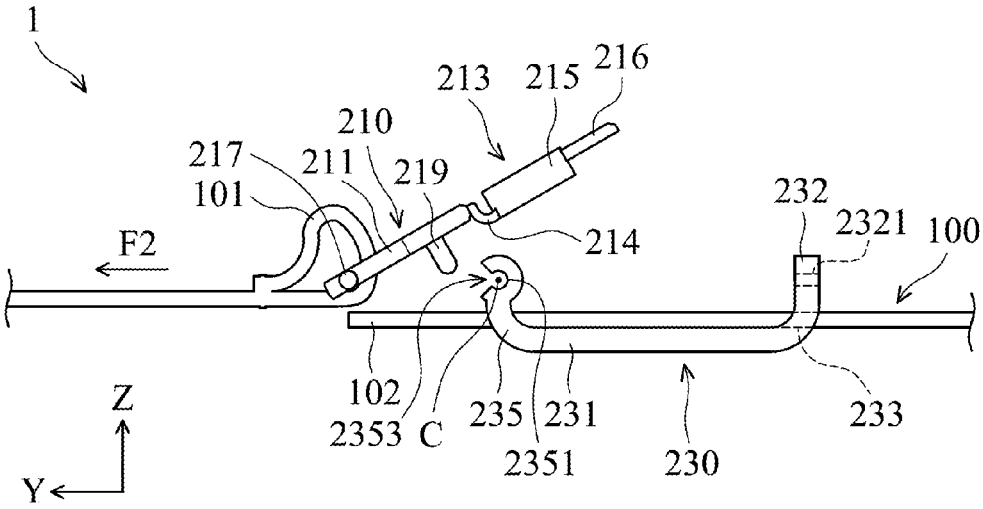
FIG. 4 shows a schematic view of the strap assembly as the first structure is being detached from the second structure, in accordance with the first embodiment of the disclosure.

While wearing the strap assembly, a user may be injured when the fastening unit is accidentally dragged by an external force. However, as shown in FIG. 4, when the strap assembly 1 is dragged by an external force F2, the first structure 210 is detached from the second structure 230 to avoid injury. Specifically, when the strap assembly 1 is dragged by the external force, the first structure 210 is pulled by a force F2 in a direction away from the fixing seat 232, and the shafts 217 of the first structure 210 are detached from the shaft holes 2351 via the guiding grooves 2353 of the shaft seats 245. Therefore, injury to the user due to the use of the strap assembly 1 may be avoided.

Figure 5:
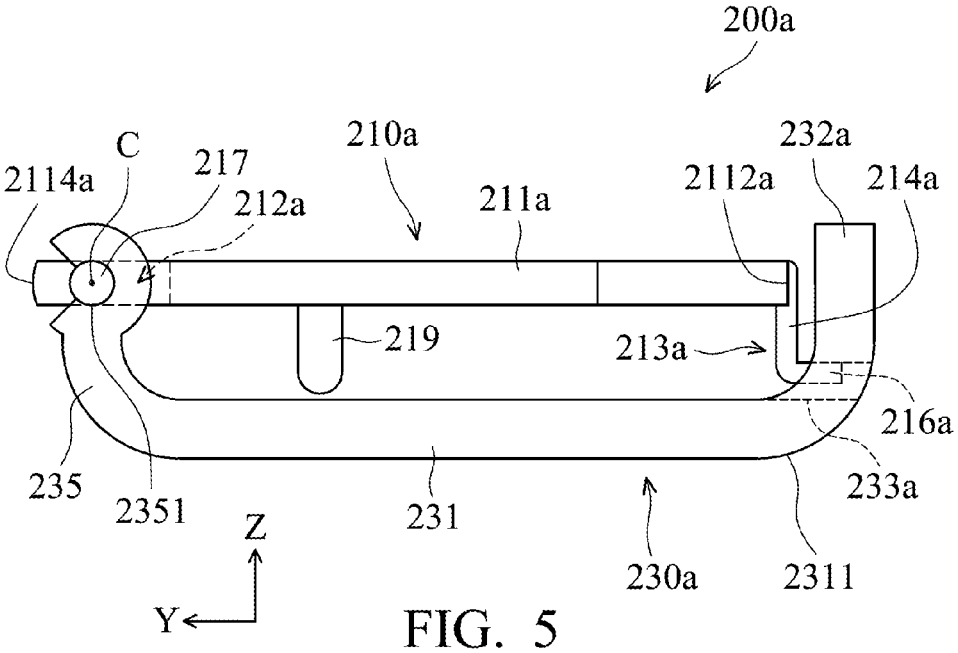
FIG. 5 shows a side view of a strap assembly, in accordance with a second embodiment of the disclosure.

FIG. 5 shows a side view of the fastening unit 200*a* of a second embodiment. The equivalent elements shown in FIG. 2 are provided with the same reference numbers here, and the features of similar elements are not reiterated in the interest of brevity. The fastening unit 200*a* includes a first structure 210*a* and a second structure 230*a*.

In the second embodiment, the second structure 230*a* includes the base 231, a fixing seat 232*a*, and two shaft seats 235. The fixing seat 232*a* extends from the first side 2311 of the base 231 upwardly. A channel 233*a* is arranged adjacent to the first side 2311 of the base 231 and penetrates the fixing seat 232*a* along a first direction (Y axis).

In the second embodiment, the first structure 210*a* includes a main body 211*a*, an engaging member 213*a*, and two shafts 217. The main body 211*a* has a front lateral edge 2112*a* and a rear lateral edge 2114*a*. In the vicinity of the rear lateral edge 2114*a* of the main body 211*a*, a through passage 212*a* penetrates the upper and lower surfaces to enable the strap 100 to be fixed on the first structure 210*a*. The two shafts 217 are respectively formed at the two sides of the main body 211*a* relative to the shaft holes 2351 of the two shaft seats 235. The engaging member 213*a* includes an extending segment 214*a* and an engaging portion 216*a*. The extending segment 214*a* is connected to the front lateral edge 2112*a* of the main body 211*a* and extends downwardly in such a way that the extending segment 214*a* is perpendicular to the main body 211 and terminates at its distal end. The engaging portion 216*a* is connected to the distal end of the extending segment 214*a* and extends along a direction opposite to the first direction (Y axis direction). The extending segment 214*a* is configured as an elastic compression portion which enables the engaging portion 216*a* to have a degree of freedom to displace.

In a closed state, the engaging portion 216*a* of the first structure 210 is received in the channel 233*a* of the second structure 230*a*. The shafts 217*a* of the first structure 210*a* are not allowed to pivot about the rotating axis C relative to the shaft seats 235 of the second structure 230. As a result, the strap (not shown in FIG. 5) is abutted thereby fixed by the abutting member 219 of the first structure 210*a*.

To adjust the length of the strap 100, a force is applied to the engaging member 213*a* of the first structure 210*a* along the first direction (Y axis direction) to allow the engaging portion 216*a* to be released from the channel 233*a*. It should be noted that, while the engaging portion 216*a* is being disengage from the channel 233*a*, the extending segment 214*a* is compressed and deformed by the force. At the same time, the extending segment 214*a* enables the engaging portion 216*a* to have a degree of freedom along the first direction (Y axis direction). As a result, the engaging portion 216*a* is movable along the first direction (Y axis direction). The operation of adjustment of the length of the strap is similar to the embodiment of FIGS. 1-4 and is not described in the interest of brevity.

Figure 6:
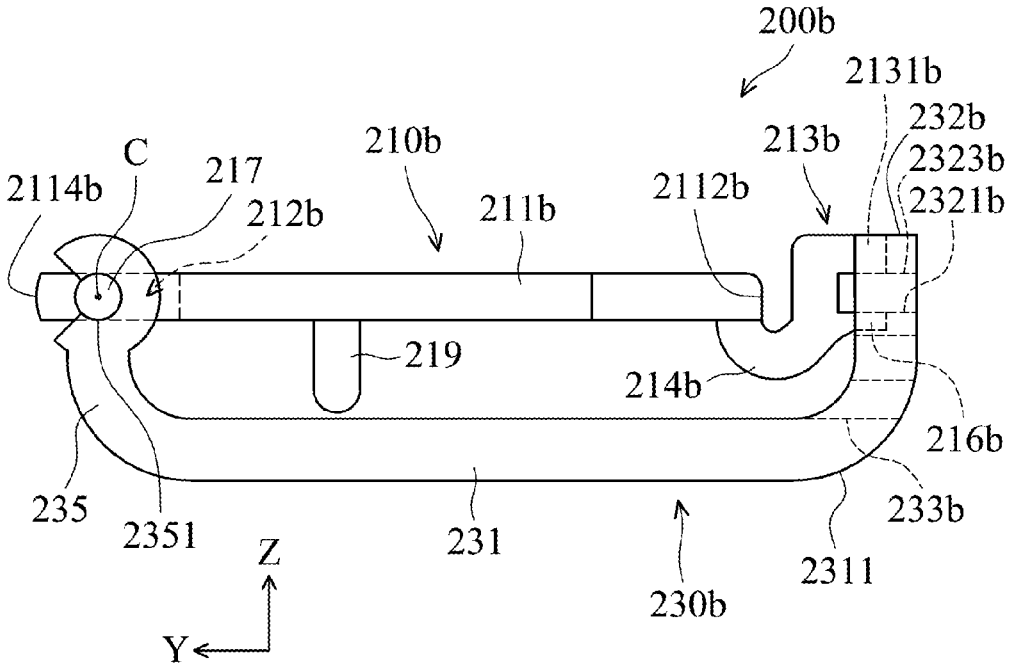
FIG. 6 shows a side view of a strap assembly, in accordance with a third embodiment of the disclosure.

FIG. 6 shows a side view of the fastening unit 200*b* of a third embodiment. In the embodiment shown in FIG. 6, similar elements which are shown in FIG. 2 are provided with the same reference numbers, and the features of similar elements are not reiterated in the interest of brevity. The fastening unit 200*b* includes a first structure 210*b* and a second structure 230*b*.

In the third embodiment, the second structure 230*b* includes the base 231*b*, a fixing seat 232*b*, and two shaft seats 235. The fixing seat 232*b* extends upwardly (Z axis direction) from the first side 2311 of the base 231. A channel

233*b* is arranged adjacent to the first side 2311 and penetrates the fixing seat 232*b* along a first direction (along the Y axis). A through hole 2321*b* is formed on the fixing seat 232*b* at the side of the channel 233*b* that is away from the base 231*b*, and the through hole 2321*b* penetrates the fixing seat 232*b* along the first direction (Y axis). In addition, a recess 2323*b* is formed at the top end of the fixing seat 232*b*.

In the third embodiment, the first structure 210*b* includes a main body 211*b*, an engaging member 213*b*, two shafts 217, and an abutting member 219. The main body 211*b* has a front lateral edge 2112*b* and a rear lateral edge 2114*b*. In the vicinity of the rear lateral edge 2114*b* of the main body 211*b*, a through passage 212*b* penetrates the upper and lower surfaces to enable the strap 100 to be fixed on the first structure 210*a*. The two shafts 217 are respectively formed at two sides of the main body 211*b* relative to the shaft holes 2351 of the two shaft seats 235. The engaging member 213*b* includes an extending segment 214*b* an engaging portion 216*b*, and a projection 2131*b*. As shown in FIG. 6, the extending segment 214*b* has a U-shaped cross section and is arranged adjacent to the front lateral edge 2112*b* and is positioned on the bottom surface of the main body 211*b*. The engaging portion 216*b* and the projection 2131*b* are respectively arranged corresponding to the through hole 2321*b* and the recess 2323*b* and are formed on the extending segment 214*b*, in which the engaging portion 216*b* and the projection 2131*b* extend along a direction opposite to the first direction (Y axis direction). The extending segment 214*b* is configured as an elastic compression portion which enables the engaging portion 216*b* and the projection 2131*b* to have a degree of freedom to displace.

As the fastening unit 200*b* is in a closed state, the engaging portion 216*b* of the first structure 210*b* is received in the through hole 2321*b* of the second structure 230*b*, and the projection 2131*b* of the first structure 210*b* is in the recess 2323*b* of the second structure 230*b*. Since the engaging portion 216*b* is limited by the through hole 2321*b*, the shafts 217 of the first structure 210*b* are not allowed to pivot about the rotating axis C relative to the shaft seats 235 of the second structure 230*b*. As a result, the strap (not shown in FIG. 6) which passes through the channel 233*b* is abutted by the abutting member 219 of the first structure 210*b*.

To adjust the length of the strap 100, a force is applied to the projection 2131*b* of the first structure 210*b* along the first direction (Y axis direction) to allow the engaging portion 216*b* to be released from the through hole 2321*b*. It should be noted that, while the engaging portion 216*b* is being disengaged from the through hole 2321*b*, the extending segment 214*b* is compressed and deformed by the force. At the same time, the extending segment 214*a* enables the engaging portion 216*b* to have a degree of freedom along the first direction (Y axis direction) and/or along the third direction (Z axis direction). As a result, the engaging portion 216*b* is movable along the first direction (Y axis direction) and/or the third direction (Z axis direction). The remaining operations to adjust the length of the strap are similar to the embodiment of FIGS. 1-4 and are not described for brevity.

The strap assembly of the disclosure can not only be used to adjust the length of the strap but also protect the personal safety of the user. Due to the decrease of the number of elements, compared with the conventional strap assembly, the cost of the strap assembly of the disclosure is reduced, and the process for manufacturing it can be simplified. Additionally, since the surplus portion of the strap can be limited by adjusting the ring, the user may feel more comfort, and accidents can be prevented as well.

While the disclosure has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fastening unit, comprising:

a base;

a fixing seat disposed on the base;

two shaft seats arranged side by side and disposed on the base in such a way that the two shaft seats are spaced apart from each other in a second direction, wherein each of the two shaft seats is spaced from the fixing seat along a first direction by a distance, and the first direction is perpendicular to the second direction;

a main body having two shafts in cylindrical shape respectively formed at two sides thereof, wherein each of the two shaft seats comprises a shaft hole and a guiding groove connecting the shaft hole, the two shafts are pivotably disposed on the two shaft holes of the two shaft seats, the guiding groove is formed at a side of the shaft seat that is away from the fixing seat;

an engaging member connected to a side of the main body that is away from the two shaft seats; and an abutting member projecting from a bottom surface of the main body;

wherein when the fastening unit is in a closed state, the engaging member engages with the fixing seat, and the bottom surface faces the base such that the abutting member is adjacent to the base, and the two shafts of the main body are capable of being released from the two shaft seats in the first direction via the guiding groove when an external force is applied in the closed state; and when the fastening unit is transferred from the closed state to an opened state, the engaging member disengages from the fixing seat, and the main body pivots relative to the two shaft seats.

2. The fastening unit as claimed in claim 1, wherein the engaging member comprises:

an elastic compression portion connected to the main body; and an engaging portion connected to the main body via the elastic compression portion and configured to engage with the fixing seat;

wherein when the fastening unit is transferred from the closed state to an opened state, the elastic compression portion is deformed so as to facilitate the disengagement of the elastic compression portion from the fixing seat.

3. The fastening unit as claimed in claim 2, wherein the elastic compression portion comprises an extending segment enabling the engaging portion to have a degree of freedom along the first direction and/or a degree of freedom in a third direction perpendicular to the first and second directions.

4. The fastening unit as claimed in claim 3, wherein the elastic compression portion further comprises a flexible segment connecting the extending segment to the engaging portion and enabling the engaging portion to have a degree of freedom along the first direction.

5. The fastening unit as claimed in claim 1, wherein a channel penetrates the fixing seat along the first direction, and the channel enables a strap to pass therethrough.

6. The fastening unit as claimed in claim 5, wherein a through hole is formed on the fixing seat at a side of the channel that is away from the base, and when the fastening unit is in the closed state, the engaging member is connected to the fixing seat via the through hole.

7. The fastening unit as claimed in claim 1, wherein a through passage is formed at a side of the main body that is opposite to a side of the main body at which the engaging member is connected, and the through passage is configured to facilitate a strap passing therethrough.

8. A fastening unit, comprising:

a fastening unit as claimed in claim 1, wherein a through passage is formed at a side of the main body that is opposite to a side of the main body at which the engaging member is connected, and a channel is arranged passing through the fixing seat along the first direction; and a strap, wherein a first end of the strap is fixed on the through passage, and a second end of the strap passes through the channel and the interspace between the two shaft seats in order;

wherein when the fastening unit is in the closed state, the second end of the strap is abutted by the abutting member so as to position the strap on the base.

* * * * *